US009293806B2

(12) United States Patent
Kwong et al.

(10) Patent No.: US 9,293,806 B2
(45) Date of Patent: Mar. 22, 2016

(54) ELECTRONIC DEVICE WITH DISPLAY FRAME ANTENNA

(71) Applicant: Apple Inc., Cupertino, CA (US)

(72) Inventors: Kelvin Kwong, Cupertino, CA (US); Lee E. Hooton, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 134 days.

(21) Appl. No.: 14/201,501

(22) Filed: Mar. 7, 2014

(65) Prior Publication Data

US 2015/0255853 A1 Sep. 10, 2015

(51) Int. Cl.
*H01Q 1/24* (2006.01)
*H01Q 1/22* (2006.01)

(52) U.S. Cl.
CPC ..... *H01Q 1/24* (2013.01); *H01Q 1/2258* (2013.01); *H01Q 1/243* (2013.01)

(58) Field of Classification Search
CPC ..... H01Q 1/22; H01Q 1/2258; H01Q 1/2283; H01Q 1/2291; H01Q 1/241–1/243
USPC ..... 343/702
See application file for complete search history.

(56) References Cited

U.S. PATENT DOCUMENTS 6,804,881 B1 * 10/2004 Shipley ..... C25D 5/022 174/262
7,545,628 B2 * 6/2009 Takuma ..... G06F 1/1616 349/58
7,852,273 B2 12/2010 Saitou
7,982,675 B2 * 7/2011 Tsujimura ..... H01Q 1/22 343/702
8,072,388 B2 * 12/2011 Nysen ..... H01Q 1/2258 343/702
8,269,675 B2 * 9/2012 Kough ..... H01Q 1/2266 343/702
8,326,347 B2 12/2012 Wagner et al.
8,669,909 B2 3/2014 Yamaguchi et al.
8,922,527 B2 * 12/2014 Ryshtun ..... G06F 3/0416 345/174
2009/0135073 A1 5/2009 Yokote et al.
2010/0026590 A1 2/2010 Chiang et al.
2011/0025922 A1 * 2/2011 Toya ..... G02F 1/133308 348/731
2012/0050114 A1 * 3/2012 Li ..... H01Q 1/2266 343/702
2013/0076574 A1 * 3/2013 Rappoport ..... H01Q 1/243 343/702
2013/0335275 A1 12/2013 Sanford et al.

* cited by examiner

*Primary Examiner* — Howard Williams
(74) *Attorney, Agent, or Firm* — Treyz Law Group, P.C.; G. Victor Treyz; Joseph F. Guihan

(57) ABSTRACT

An electronic device has a display mounted in a housing using a plastic display frame. The display has an active area and an inactive area. A display cover layer may have polymer coating layers in the inactive area. The display frame may lie under the inactive area. A patterned metal coating layer may be formed on the display frame. The patterned metal coating layer may have portions that form adhesion promotion structures for promoting adhesion between the frame and the adhesive. The patterned metal coating layer may also have portions that form antenna structures. The antenna structures may be used to transmit and receive radio-frequency signals and may be used as adhesion promotion structures. Adhesive may be interposed between the polymer coating layers and the metal coating layer on the display frame to attach the display cover layer and the display to the display frame.

20 Claims, 13 Drawing Sheets

ELECTRONIC DEVICE WITH DISPLAY FRAME ANTENNA

BACKGROUND

This relates generally to electronic devices and, more particularly, to electronic devices with antennas.

Electronic devices often include antennas. For example, cellular telephones, computers, and other devices often contain antennas for supporting wireless communications.

It can be challenging to form electronic device antenna structures with desired attributes. In some wireless devices, the presence of conductive structures such as electronic components and housing structures can influence antenna performance. Antenna performance may not be satisfactory if the conductive structures are not configured properly and interfere with antenna operation. Device size can also affect performance. It can be difficult to achieve desired performance levels in a compact device, particularly when the compact device has conductive housing structures and electronic components with conductive structures.

It would therefore be desirable to be able to provide improved wireless circuitry for electronic devices.

SUMMARY

An electronic device may be provided with a display. The display may be mounted in a housing using a plastic display frame. The plastic display frame may be attached to the housing using screws or other attachment mechanisms.

The display may have display structures such as liquid crystal display structures or organic light-emitting diode display structures that display images in an active area of the display. The display may also have an inactive area that forms a border surrounding the active area.

A display cover layer may have an opaque masking layer or other polymer coating layers in the inactive area. The display frame may have a surface that lies under the inactive area. Adhesive may be interposed between the polymer coating layers and the surface of the display frame to attach the display cover layer and the display to the display frame.

A patterned metal coating layer may be formed on the display frame. The patterned metal coating layer may have portions that form adhesion promotion structures for promoting adhesion between the frame and the adhesive. The patterned metal coating layer may also have portions that form antenna structures. The antenna structures may be used to transmit and receive radio-frequency signals and may be used as adhesion promotion structures.

DETAILED DESCRIPTION

Electronic devices may be provided with displays and other components. Displays and other components may be mounted in the housing of an electronic device using component support structures such as plastic display frames. A plastic display frame may be provided with adhesion promotion structures for enhancing bond strength in adhesive bonds between the plastic frame and other structures. An adhesion promotion structure on a plastic frame may, for example, enhance adhesion the frame and a layer of adhesive that is being used to attach the display cover layer to the plastic frame. Metal structures on plastic frames or other support structures may also be used in forming antennas. Illustrative electronic devices that may be provided with antenna structures that can promote adhesion and other adhesion promotion structures are shown in FIGS. 1, 2, 3, and 4.

Figure 1:
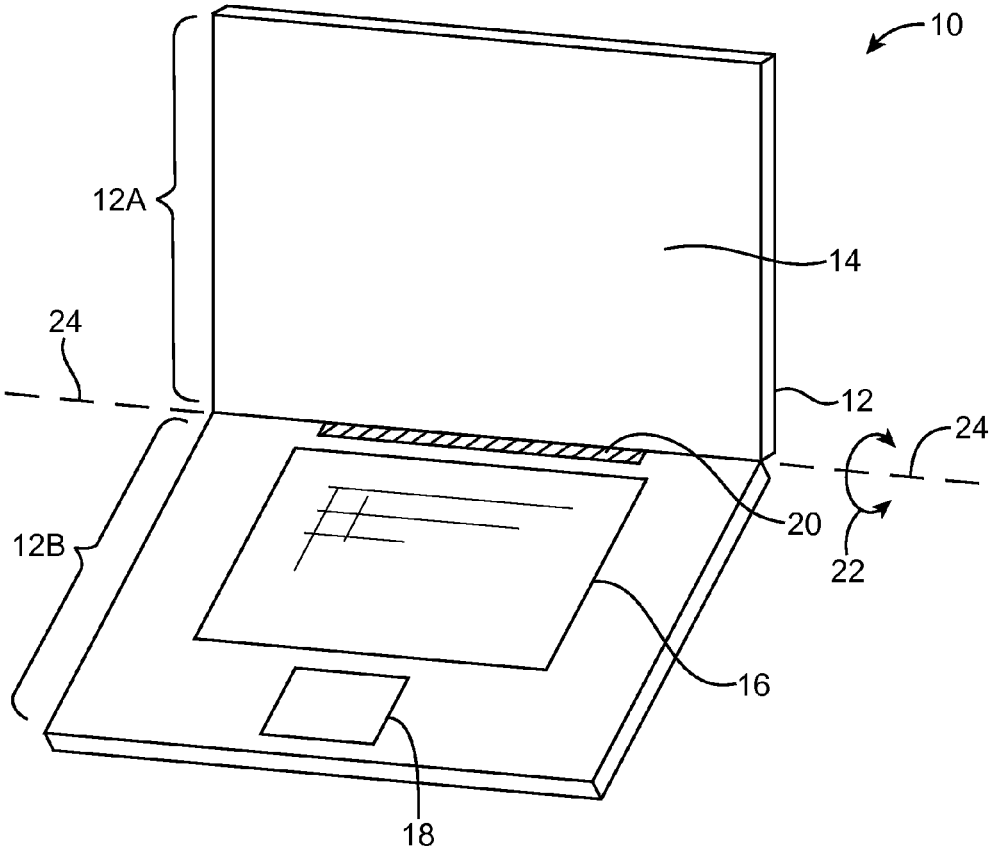
FIG. 1 is a perspective view of an illustrative electronic device such as a laptop computer in accordance with an embodiment.

Electronic device 10 of FIG. 1 has the shape of a laptop computer and has upper housing 12A and lower housing 12B with components such as keyboard 16 and touchpad 18. Device 10 has hinge structures 20 (sometimes referred to as a clutch barrel) to allow upper housing 12A to rotate in directions 22 about rotational axis 24 relative to lower housing 12B. Display 14 is mounted in housing 12A. Upper housing 12A, which may sometimes be referred to as a display housing or lid, is placed in a closed position by rotating upper housing 12A towards lower housing 12B about rotational axis 24.

Figure 2:
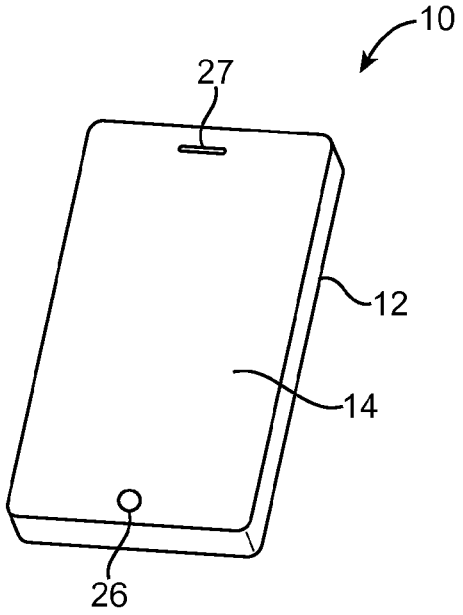
FIG. 2 is a perspective view of an illustrative electronic device such as a handheld electronic device in accordance with an embodiment.

FIG. 2 shows an illustrative configuration for electronic device 10 based on a handheld device such as a cellular telephone, music player, gaming device, navigation unit, or other compact device. In this type of configuration for device 10, device 10 has opposing front and rear surfaces. The rear surface of device 10 may be formed from a planar portion of housing 12. Display 14 forms the front surface of device 10. Display 14 may have an outermost layer that includes openings for components such as button 26 and speaker port 27.

Figure 3:
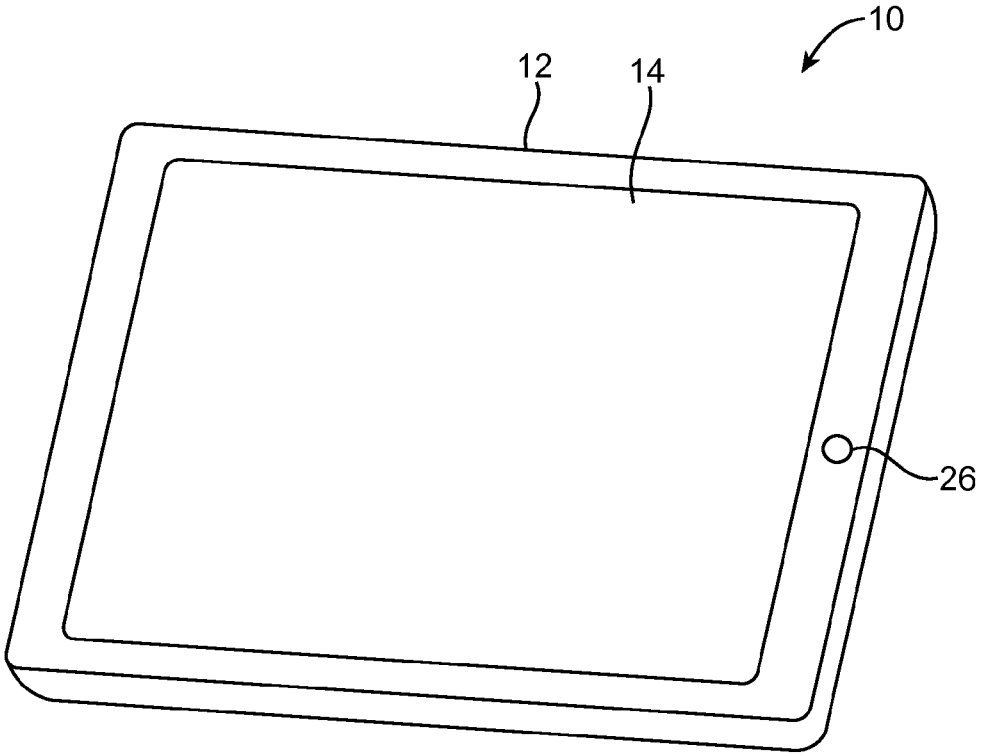
FIG. 3 is a perspective view of an illustrative electronic device such as a tablet computer in accordance with an embodiment.

In the example of FIG. 3, electronic device 10 is a tablet computer. In electronic device 10 of FIG. 3, device 10 has opposing planar front and rear surfaces. The rear surface of device 10 is formed from a planar rear wall portion of housing 12. Curved or planar sidewalls may run around the periphery of the planar rear wall and may extend vertically upwards. Display 14 is mounted on the front surface of device 10 in housing 12. As shown in FIG. 3, display 14 has an outermost layer with an opening to accommodate button 26.

Figure 4:
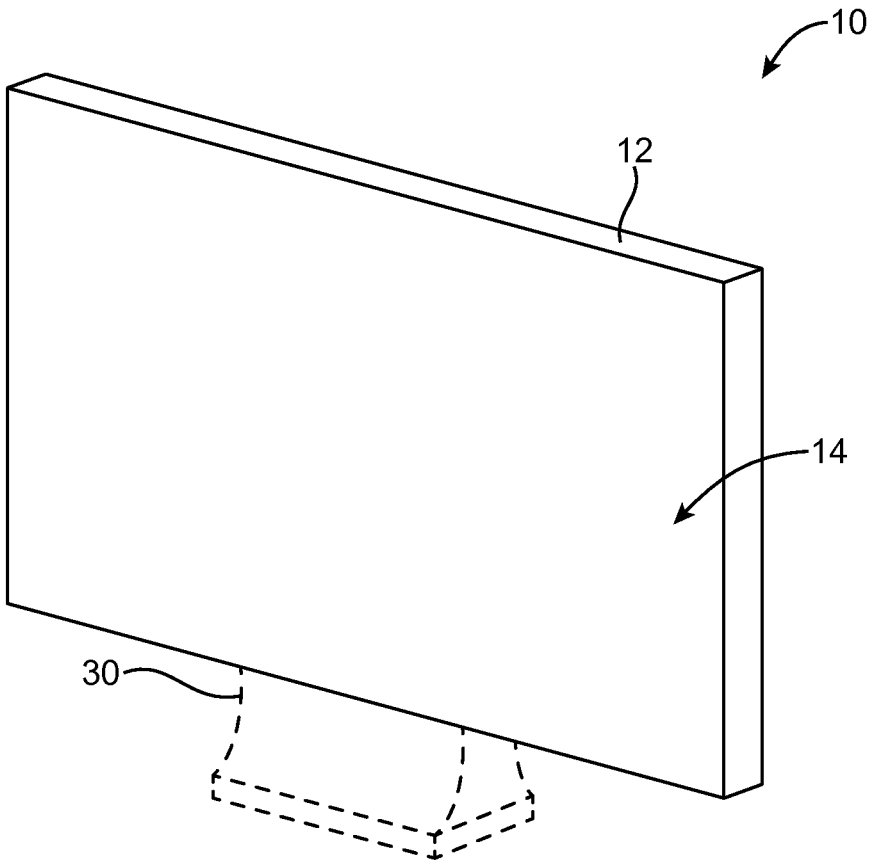
FIG. 4 is a perspective view of an illustrative electronic device such as a display for a computer or television in accordance with an embodiment.

FIG. 4 shows an illustrative configuration for electronic device 10 in which device 10 is a computer display, a computer that has an integrated computer display, or a television. Display 14 is mounted on a front face of device 10 in housing 12. With this type of arrangement, housing 12 for device 10 may be mounted on a wall or may have an optional structure such as support stand 30 to support device 10 on a flat surface such as the surface of a table.

An electronic device such as electronic device 10 of FIGS. 1, 2, 3, and 4, may, in general, be a computing device such as a laptop computer, a computer monitor containing an embedded computer, a tablet computer, a cellular telephone, a media player, or other handheld or portable electronic device, a smaller device such as a wrist-watch device, a pendant device, a headphone or earpiece device, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment. The examples of FIGS. 1, 2, 3, and 4 are merely illustrative.

Device 10 may include a display such as display 14. Display 14 may be mounted in housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal housing structure, one or more structures that form exterior housing surfaces, etc.).

Display 14 may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Capacitive touch screen electrodes may be formed from an array of indium tin oxide pads or other transparent conductive structures.

Display 14 may include an array of display pixels formed from liquid crystal display (LCD) components, an array of electrophoretic display pixels, an array of plasma display pixels, an array of organic light-emitting diode display pixels, an array of electrowetting display pixels, or display pixels based on other display technologies.

Display 14 may be protected using a display cover layer such as a layer of transparent glass or clear plastic. Openings may be formed in the display cover layer. For example, an opening may be formed in the display cover layer to accommodate a button, an opening may be formed in the display cover layer to accommodate a speaker port, etc.

Housing 12 may be formed from conductive materials such as metal (e.g., aluminum, stainless steel, etc.) and/or insulating materials (e.g., plastic, fiber-composites, etc.). Antennas in device 10 may be mounted behind plastic portions of housing 12, behind plastic antenna windows formed within openings in a metal housing, under dielectric structures such as glass or plastic portions of display 14, or elsewhere in device 10 where antenna signals will not be blocked by the presence of conductive structures.

Figure 5:
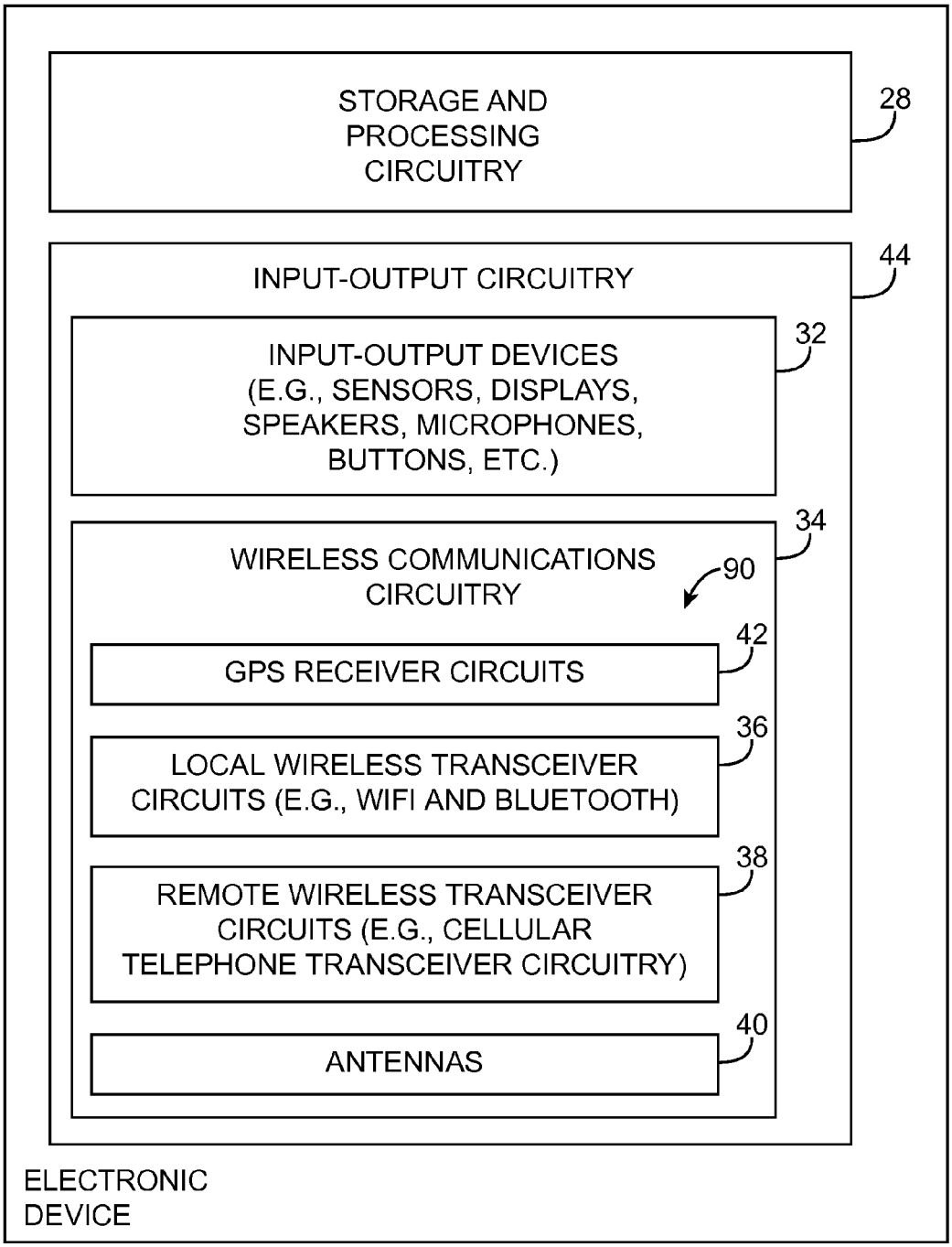
FIG. 5 is a schematic diagram of illustrative circuitry in an electronic device in accordance with an embodiment.

A schematic diagram showing illustrative components that may be used in device 10 is shown in FIG. 5. As shown in FIG. 5, device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. This processing circuitry may be based on one or more microprocessors, microcontrollers, digital signal processors, application specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, MIMO protocols, antenna diversity protocols, etc.

Input-output circuitry 44 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices may include touch screens, displays without touch sensor capabilities, buttons, joysticks, click wheels, scrolling wheels, touch pads, key pads, keyboards, microphones, cameras, buttons, speakers, status indicators, light sources, audio jacks and other audio port components, digital data port devices, light sensors, motion sensors (accelerometers), capacitance sensors, proximity sensors, etc.

Input-output circuitry 44 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 34 may include radio-frequency transceiver circuitry 90 for handling various radio-frequency communications bands. For example, circuitry 34 may include transceiver circuitry 36, 38, and 42. Transceiver circuitry 36 may be wireless local area network transceiver circuitry that may handle 2.4 GHz and 5 GHz bands for WiFi® (IEEE 802.11) communications and that may handle the 2.4 GHz Bluetooth® communications band. Circuitry 34 may use cellular telephone transceiver circuitry 38 for handling wireless communications in frequency ranges such as a low communications band from 700 to 960 MHz, a midband from 1710 to 2170 MHz, and a high band from 2300 to 2700 MHz or other communications bands between 700 MHz and 2700 MHz or other suitable frequencies (as examples). Circuitry 38 may handle voice data and non-voice data. Wireless communications circuitry 34 can include circuitry for other short-range and long-range wireless links if desired. For example, wireless communications circuitry 34 may include 60 GHz transceiver circuitry, circuitry for receiving television and radio signals, paging system transceivers, near field communications (NFC) circuitry, etc. Wireless communications circuitry 34 may include satellite navigation system circuitry such as global positioning system (GPS) receiver circuitry 42 for receiving GPS signals at 1575 MHz or for handling other satellite positioning data. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include antennas 40. Antennas 40 may be formed using any suitable antenna types. For example, antennas 40 may include antennas with resonating elements that are formed from loop antenna structures, patch antenna structures, inverted-F antenna structures, slot antenna structures, planar inverted-F antenna structures, helical antenna structures, hybrids of these designs, etc. Different types of antennas may be used for different bands and combinations of bands. For example, one type of antenna may be used in forming a local wireless link antenna and another type of antenna may be used in forming a remote wireless link antenna.

Figure 6:
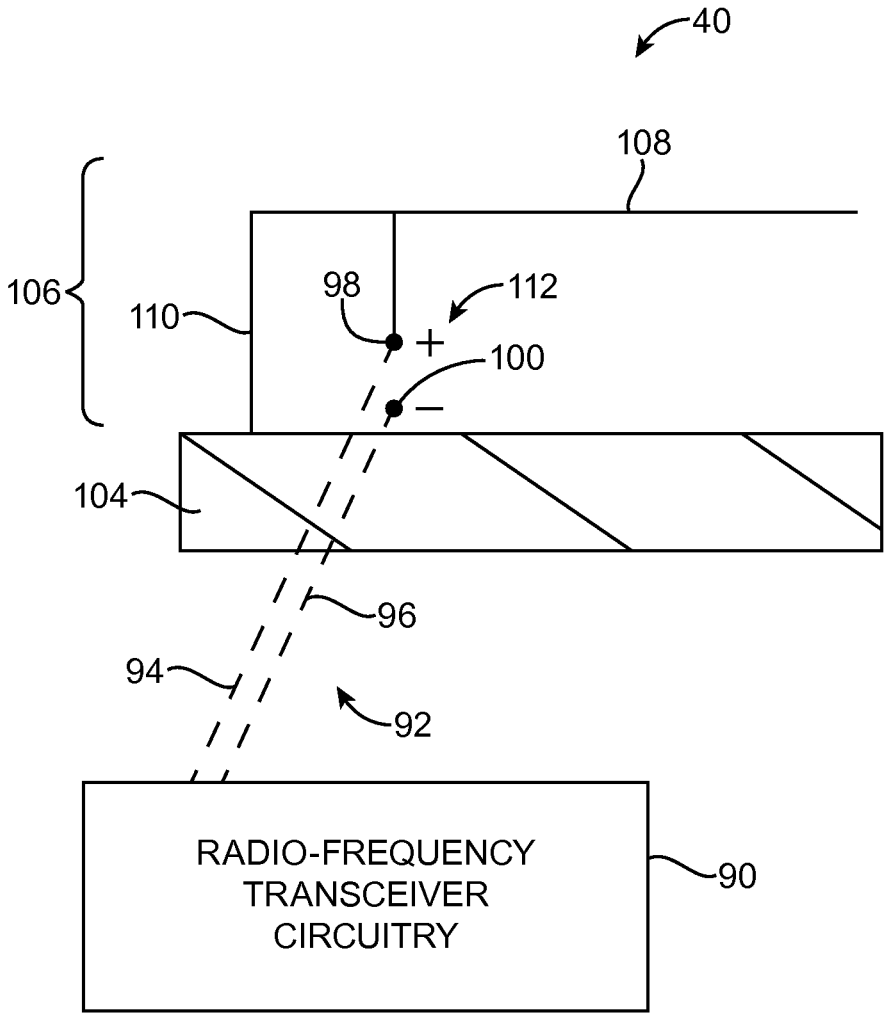
FIG. 6 is a diagram of an illustrative antenna in accordance with an embodiment.

As shown in FIG. 6, transceiver circuitry 90 in wireless circuitry 34 may be coupled to antenna structures 40 using paths such as path 92. To provide antenna structures 40 with the ability to cover communications frequencies of interest, antenna structures 40 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna). If desired, antenna structures 40 may be provided with adjustable circuits such as tunable components that tune antenna structures 40 over communications bands of interest. Tunable components in antenna structures 40 may include tunable inductors, tunable capacitors, or other tunable components. Tunable components such as these may be based on switches and networks of fixed components, distributed metal structures that produce associated distributed capacitances and inductances, variable solid state devices for producing variable capacitance and inductance values, tunable filters, or other suitable tunable structures. During operation of device 10, control circuitry 28 (FIG. 5) may issue control signals adjust inductance values, capacitance values, or other parameters associated with the tunable components, thereby tuning antenna structures 40 to cover desired communications bands. Configurations in which antenna structures 40 are fixed and are not tuned with adjustable components may also be used.

Path 92 may include one or more transmission lines. As an example, signal path 92 of FIG. 6 may be a transmission line having a positive signal conductor such as line 94 and a ground signal conductor such as line 96. Lines 94 and 96 may form parts of a coaxial cable or a microstrip transmission line on a substrate such as a printed circuit (as examples). A matching network formed from components such as inductors, resistors, and capacitors may be used in matching the impedance of antenna structures 40 to the impedance of transmission line 92. Matching network components may be provided as discrete components (e.g., surface mount technology components) or may be formed from housing structures, printed circuit board structures, traces on plastic supports, etc. Components such as these may also be used in forming filter circuitry in antenna structures 40.

Transmission line 92 may be directly coupled to an antenna resonating element and ground for antenna 40 or may be coupled to near-field-coupled antenna feed structures that are used in indirectly feeding a resonating element for antenna 40. As an example, antenna structures 40 may form an inverted-F antenna of the type shown in FIG. 6 that is fed by transmission line 92 at antenna feed 112. As shown in FIG. 6, antenna feed 112 of inverted-F antenna 40 has a positive antenna feed terminal such as terminal 98 and a ground antenna feed terminal such as ground antenna feed terminal 100. Positive transmission line conductor 94 may be coupled to positive antenna feed terminal 98 and ground transmission line conductor 96 may be coupled to ground antenna feed terminal 92.

As another example, antenna structures 40 may include an antenna resonating element such as a slot antenna resonating element or other element that is indirectly fed using near-field coupling. In a near-field coupling arrangement, transmission line 92 is coupled to a near-field-coupled antenna feed structure that is used to indirectly feed antenna structures such as an antenna slot or other element through near-field electromagnetic coupling.

Inverted-F antenna 40 of FIG. 6 has antenna resonating element 106 and antenna ground (ground plane) 104. Antenna resonating element 106 may have a main resonating element arm such as arm 108. The length of arm 108 may be selected so that antenna 40 resonates at desired operating frequencies. For example, the length of arm 108 may be a quarter of a wavelength at a desired operating frequency for antenna 40. Antenna 40 may also exhibit resonances at harmonic frequencies.

Main resonating element arm 108 may be coupled to ground 104 by return path 110. Antenna feed 112 may include positive antenna feed terminal 98 and ground antenna feed terminal 100 and may run in parallel to return path 110 between arm 108 and ground 104. If desired, inverted-F antennas such as illustrative antenna 40 of FIG. 6 may have more than one resonating arm branch (e.g., to create multiple frequency resonances to support operations in multiple communications bands) or may have other antenna structures (e.g., parasitic antenna resonating elements, tunable components to support antenna tuning, etc.). A planar inverted-F antenna (PIFA) may be formed by implementing arm 108 using planar structures (e.g., a planar metal structure such as a metal patch or strip of metal that extends into the page of FIG. 6). In general, electronic device 10 may include one or more antennas of any suitable type. The inverted-F antenna of FIG. 6 is merely illustrative.

Figure 7:
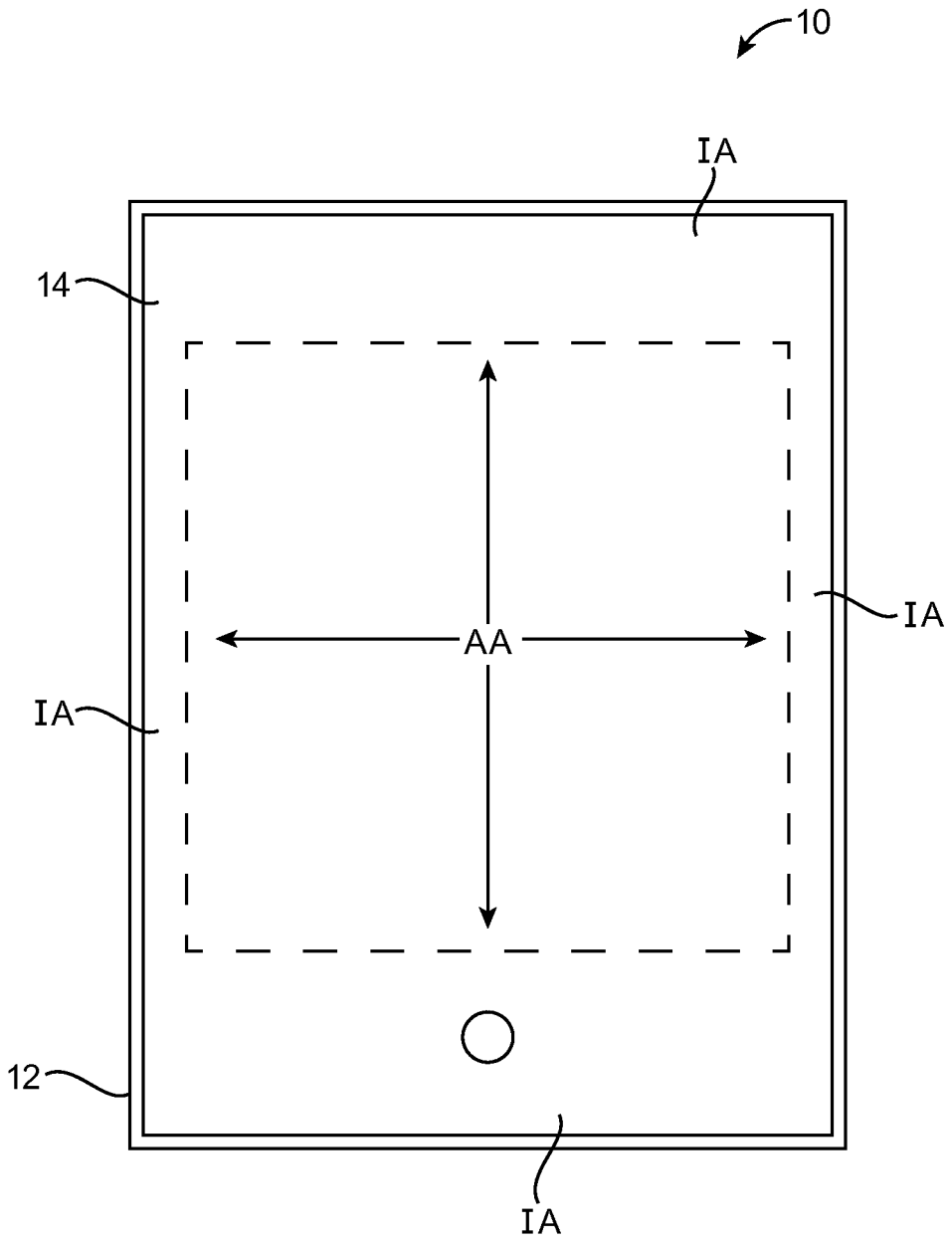
FIG. 7 is a top view of an illustrative electronic device display in accordance with an embodiment.

FIG. 7 is a top (front) view of an illustrative electronic device display. As shown in FIG. 7, display 14 may be mounted in housing 12 and may have a rectangular footprint. Display 14 may have a rectangular central region that contains liquid crystal display pixels, organic light-emitting diode display pixels or other structures that display images. This central region is sometimes referred to as active area AA. The edges of the display 14 that surround active area AA form a rectangular peripheral ring. This border region contains circuitry such as signal lines and display driver circuitry that does not emit light and is therefore referred to as the inactive portion of the display. The inactive border region of display 14 is shown as inactive area IA in FIG. 7. To hide internal components in device 10 from view by the user of device 10, it may be desirable to coat the inner surface of display 14 in inactive area IA with an opaque masking material such as a layer of ink (e.g., black ink, white ink, ink with a different color, or other opaque material) and/or other coating layers (e.g., polymer coating layers).

Figure 8:
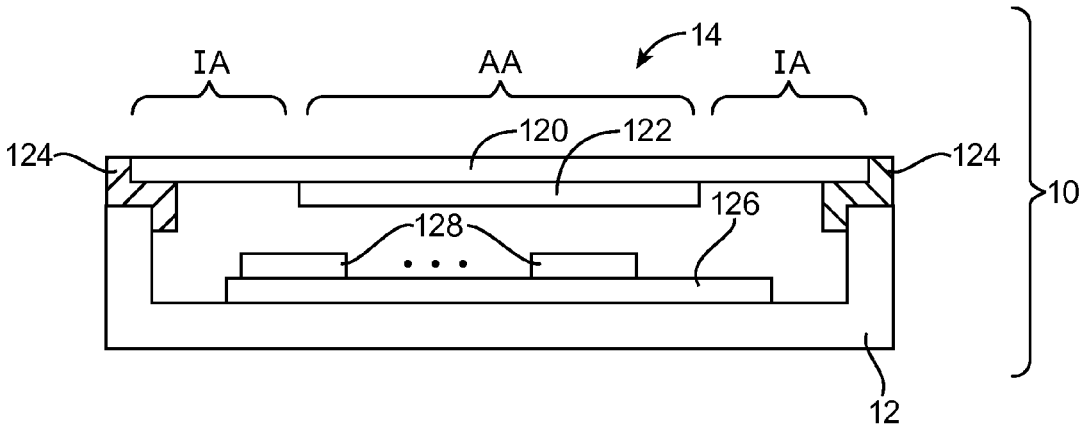
FIG. 8 is a cross-sectional side view of an illustrative electronic device in accordance with an embodiment.

A cross-sectional side view of device 10 of FIG. 7 is shown in FIG. 8. As shown in FIG. 8, display 14 may include a display module (sometimes referred to as a display, display structures, or display layers) such as display module 122. Display module 122 may be a liquid crystal display, an organic light-emitting diode display, or other display that generates images in active area AA. Display 14 may also include a cover layer such as display cover layer 120. Display module 122 may be attached to display cover layer 120 using adhesive or other attachment mechanisms. If desired, touch sensor functionality may be incorporated into display 14 by mounting a capacitive touch sensor or other touch-sensitive component between display module 122 and display cover layer 120 and/or by incorporating capacitive touch sensor electrodes or other touch sensor structures into display module 122.

Display cover layer 120 may be formed from one of the layers of display module 122 (e.g., a color filter layer or a thin-film transistor layer in a liquid crystal display that has extended edge portions) or may be formed from a separate layer of transparent material such as a layer of clear glass or plastic. Examples in which layer 120 is a display cover layer that is separate from the other layers of display module 122 are sometimes described herein as an example. This is, however, merely illustrative. Layer 120 may be any suitable layer in display 14 (e.g., a color filter layer, a thin-film transistor layer, a display cover layer, other display layers, etc.).

Device 10 may include internal components such as electronic components 128. Components 128 may include integrated circuits, sensors, connectors, switches, audio components, and other circuitry. Components 128 may be mounted on one or more substrates such as substrate 126. Substrate 126 may be a printed circuit such as a rigid printed circuit board (e.g., a printed circuit formed from a rigid printed circuit board material such as fiberglass-filled epoxy) or a flexible printed circuit (e.g., a printed circuit formed from a flexible layer of polyimide or a sheet of other polymer material). If desired, components in device 10 such as components 128 may be mounted on plastic carriers and other supports.

To hide internal components in device 10 from view, the inner surface of display cover layer 120 may be covered with a layer of opaque masking material in the portion of display cover layer 120 that overlaps inactive area. Display 14 (e.g., display cover layer 120) may be mounted in housing 12 using a support structure such as display frame 124. Frame 124 may have a rectangular opening that receives rectangular display layers in display 14 (i.e., frame 124 may serve as a chassis for retaining and mounting the layers of display 14 within device 10).

Frame 124 may be formed from a material such as plastic. If desired, the plastic of frame 124 may be overmolded on top of metal structures that strengthen frame 124 (i.e., frame 124 may contain metal strips or other structures that are fully or partly embedded within the plastic of frame 124). Configurations in which some or all of frame 124 is formed from a dielectric material such as plastic are sometimes described herein as an example.

Fasteners such as screws, solder, welds, clips, adhesive, and other attachment mechanisms may be used in attaching display 14 to housing 12. To enhance adhesive joint strength, the surfaces of the materials to be bonded may be textured. As an example, the surface of frame 124 may be textured by injection molding frame 124 in a mold having a textured inner surface or frame 124 may be textured by roughening or patterning the surface of frame 124 using a laser, a machining tool, a press, or other equipment. As another example, the coating on the inner surface of display cover layer 120 may be textured using these techniques or other suitable texturing techniques.

Figure 9:
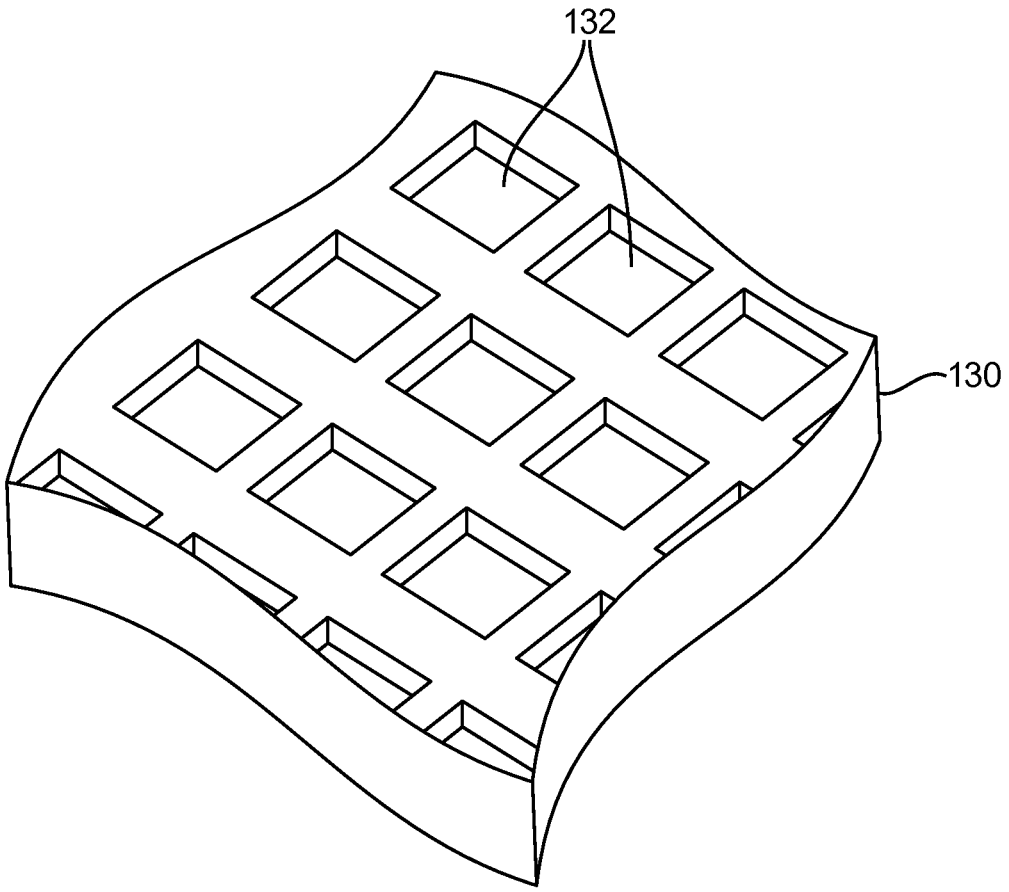
FIG. 9 is a perspective view of a textured surface of the type that may be used in promoting adhesion in adhesive joints in an electronic device in accordance with an embodiment.

A textured surface for promoting adhesion for an adhesive joint may have a regular pattern or a random pattern. An illustrative texture with a regular surface pattern for promoting adhesion is shown in FIG. 9. As shown in the illustrative example of FIG. 9, the surface of material 130 may be provided with an array of recesses such as recesses 132. Material 130 may form all or part of a coating on the underside of a display structure such as display cover layer 120, may form all or part of a plastic or other substance in frame 124 (with or without a coating layer such as a metal coating), or may form all or part of other structures in device 10 that are being joined with adhesive (e.g., frame structures, display structures, housing structures such as housing 12, etc.). Recesses 132 may have any suitable shape (e.g., square, triangular, diamond-shaped, circular, oval, shapes with straight edges, shapes with curved edges, or shapes with a combination of curved and straight edges). In the example of FIG. 9, the surface of material 130 has square openings 132 arranged in an array with rows and columns. Other shapes for recesses 132 and/or different patterns for arranging recesses 132 on the surface of material 130 may be used if desired. Recesses 132 of FIG. 9 may be formed by embossing, molding, drilling, etching, machining, pressing, or other texturing techniques.

Figure 10:
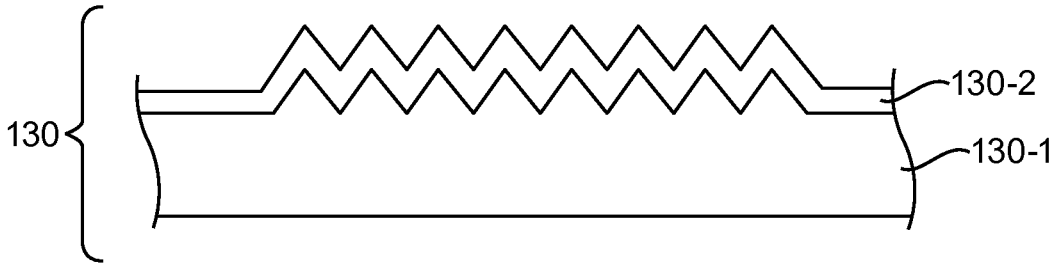
FIG. 10 is a cross-sectional side view of another illustrative textured surface of the type that may be used in promoting adhesion in adhesive joints in an electronic device in accordance with an embodiment.

FIG. 10 is a cross-sectional side view of an illustrative structure with a corrugated textured surface. As shown in FIG. 10, textured material 130 may include structure 130-1 and coating 130-2. Structure 130-1 may be a part of a display, housing, frame, or other structure. Structure 130-2 may be a coating of polymer (e.g., clear or opaque polymer adhesive ink), a metal coating, or other coating material. As the example of FIG. 10 illustrates, the textured surface of structure 130-1 may be preserved even when one or more coating layers such as coating 130-2 are incorporated before a layer of adhesive is applied to form an adhesive joint.

Using a textured surface such as the textured surfaces of FIGS. 9 and 10, adhesion between an adhesive material and the textured surface may be enhanced, thereby enhancing adhesive bond strength. Other surface textures may be used if desired. Moreover, metal coatings (see, e.g., coating 130-2) may be used to help promote adhesion. For example, if structure 130-1 is a plastic that exhibits weak adhesion to adhesive, structure 130-1 may be coated with a layer of metal (e.g., coating 130-2) that exhibits enhanced adhesion to adhesive. The metal coating in this type of scenario may serve as an adhesion promotion layer. Adhesion may be enhanced by using a textured surface with an adhesion promotion layer such as a layer of metal, may be enhanced using a layer of adhesion promoting material such as metal without texturing the surface, or may be enhanced using surface texturing without including a metal layer or other coating for promoting adhesion. The metal layer may be patterned to form antennas that can serve as adhesion promotion structures and/or may be patterned to form pads or other structures that do not serve as antennas.

Figure 11:
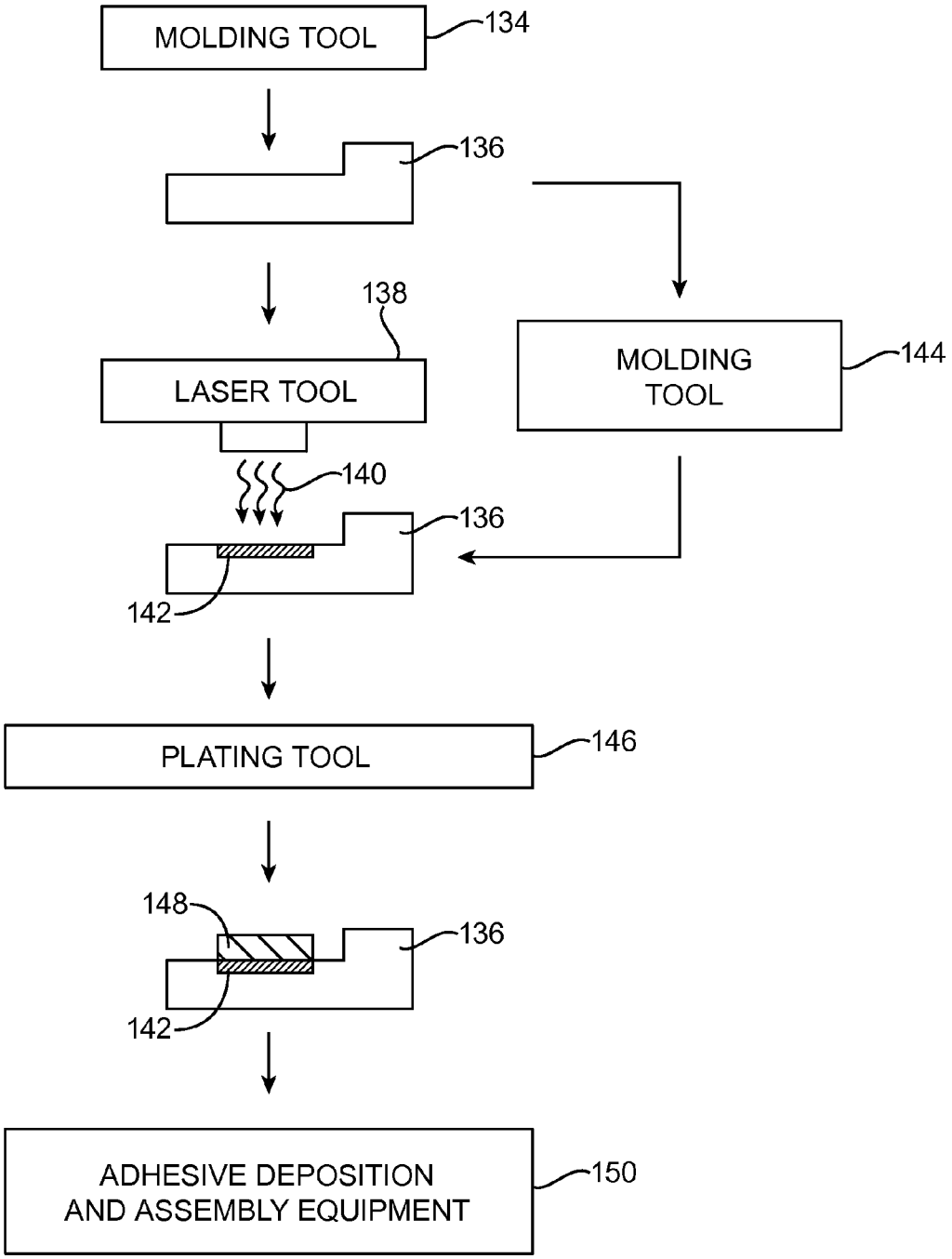
FIG. 11 is a diagram of equipment and processes involved in forming an electronic device in accordance with an embodiment.

FIG. 11 is a diagram of equipment and processes of the type that may be used in forming device 10. As shown in FIG. 11, molding equipment such as molding tool 134 may be used in forming structure 136. Molding tool 134 may, for example, be an injection molding tool that molds thermoset or thermoplastic material to form structure 136. Structure 136 may be a frame such as display frame 124 of FIG. 8, other support structures for components in device 10, or other suitable structure in device 10.

It may be desirable to coat selected portions of structure 136 with metal. For example, it may be desirable to deposit metal on structure 136 in regions of structure 136 that are to be covered with adhesive to form adhesion promotion coatings such as coating 130-2 of FIG. 10 or to form antenna structures such as antenna 40 of FIG. 6 (e.g., resonating element 106 and/or ground 104). Structure 136 may be formed from a material such as plastic and may form display frame 124 of FIG. 8.

If desired, a blanket layer of metal may be deposited over structure 136 and the blanket layer may be patterned using etching, machining, or other patterning techniques. With another illustrative approach, stamped sheet metal or other pre-patterned metal structures can be attached to selected portions of structure 136 (e.g., using adhesive). Metal can also be selectively deposited by applying metal paint or other metallic liquid to structure 136 using spraying, silk screen printing, inkjet printing, or other techniques.

As shown in FIG. 11, laser-based techniques and injection molding techniques may be used to form one or more areas such as area 142 on structure 136 that exhibit an enhanced affinity for metal deposition during electroplating operations. With one suitable approach, laser-based equipment (sometimes referred to as laser direct structuring equipment) such as laser tool 138 may apply laser light 140 to structure 136. The exposed portion of structure 136 is activated by the laser light (e.g., by activating metal compounds in the material of structure 136 or by otherwise changing the surface of structure 136) to form activated area 142. Activated area 142 has an enhanced affinity for metal growth during electroplating operations when compared to other portions of the surface of structure 136. As a result, after electroplating operations are performed using plating tool 146, metal 148 is selectively plated onto the surface of structure 136 in area 142. If desired, an area such as area 142 that has a locally enhanced affinity for metal growth during plating operations may be formed by creating structure 136 from a first shot of plastic (using a plastic with a low affinity for metal growth during plating) and by subsequently creating area 152 from a second shot of plastic (using a plastic with a higher affinity for metal growth during plating). With this approach (which is sometimes referred to as a molded interconnect device approach), tool 134 may be used to injection mold the first shot of plastic and molding tool 144 may be used to injection mold the second shot of plastic onto the first shot of plastic (or vice versa). After plating with tool 146, metal 148 is selectively grown over area 142.

After forming metal coating 148 on selected portions of structure 136, additional processing and assembly operations may be completed using equipment 150. For example, an adhesive dispensing tool may be used to deposit liquid adhesive into areas where it is desired to form adhesive joints. These areas may include, for example, portions of metal 148 that have been patterned onto structure 136 (e.g., plastic frame 124) in inactive area IA. Adhesive can be cured by applying heat, by applying ultraviolet light or other energy, etc. Assembly operations using screws and other fasteners may also be used to attach portions of device 10 together. As an example, display 14 may be attached to structure 136 using adhesive that at least partly overlaps regions on structure 136 that have been coated with metal 148 to promote adhesion. In turn, structure 136 may be attached to housing 12 using screws or other fasteners (as an example). Equipment 150 may include manually operated and computer-controlled equipment (e.g., positioners, adhesive dispensing equipment, adhesive curing equipment, etc.).

Figure 12:
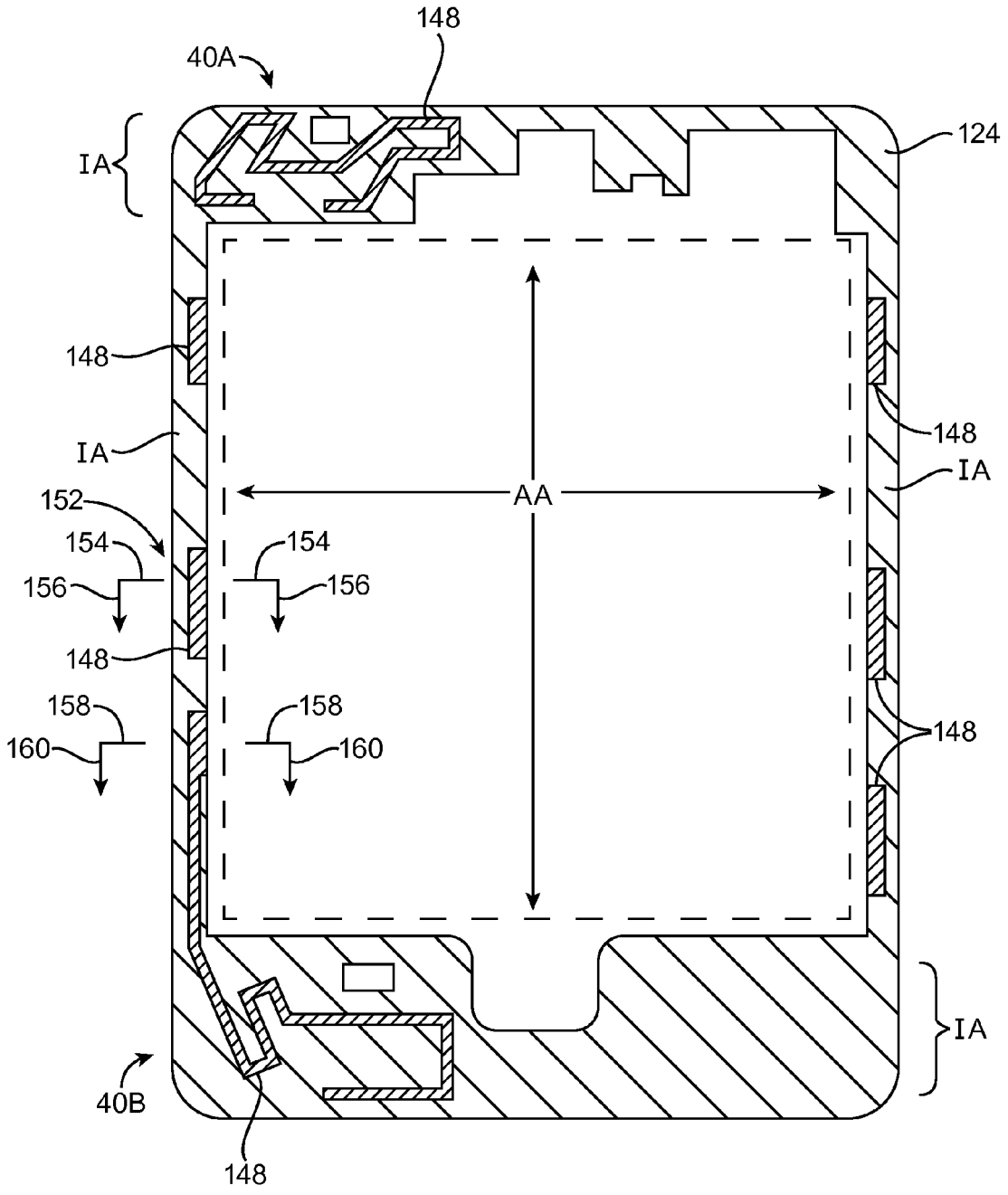
FIG. 12 is a top view of an illustrative plastic frame with metal structures for promoting adhesion with adhesive and forming antennas in accordance with an embodiment.

A top (front) view of an illustrative frame for device 10 is shown in FIG. 12. As shown in FIG. 12, frame 124 may have the shape of a rectangular ring that surrounds rectangular active area AA of display 14. A patterned layer of metal 148 may be formed in selective areas on the surface of frame 124 (i.e., in areas that are overlapped by inactive area IA and in which a layer of adhesive will subsequently be applied to attach frame 124 to display 14). Metal 148 may be formed by selectively plating a layer of metal onto regions such a region 142 on frame 124 or by otherwise locally forming regions of metal coating 148 on frame 124.

Frame 124 is preferably formed from a dielectric material such as plastic. In some portions of frame 124, metal 148 serves as an adhesion promotion structure that does not serve as an antenna and that does not carry antenna signals. For example, adhesion promotion structure 152 of FIG. 12 is formed from a layer of metal 148 that has been deposited along the left-hand edge of frame 124 in FIG. 12. In other portions of frame 124, metal 148 can be patterned to form metal structures such as antenna structures (which can also serve as adhesion promotion structures). For example, metal 148 can be patterned to from upper antenna 40A, lower antenna 40B, and/or other antennas on frame 124.

Because frame 124 is formed from a dielectric material, frame 124 does not interfere with antenna performance. The overlapping portions of display cover layer 120 in inactive area IA (e.g., the clear plastic or glass layers that overlap antennas 40A and 40B), are likewise formed from dielectric and do not interfere with antenna performance. In the example of FIG. 12, there are two antennas (40A and 40B) that have been formed from metal 148 and five adhesion promotion structures that do not carry antenna signals such as adhesion promotion structure 152. Other numbers of antennas and non-antenna adhesion promotion structures may be incorporated onto frame 124 if desired. For example, there may be one antenna 40 on frame 124, more than one antenna 40 on frame 124, two or more antennas on frame 124, or three or more antennas on frame 124. There may be one or more adhesion promotion structures 152 formed from metal 148, two or more adhesion promotion structures 152 formed from metal 148, or three or more adhesion promotion structures 152 formed from metal 148. Configurations for frame 124 in which no antennas are present and/or no non-antenna metal adhesion promotion structures are present may also be used. If desired, textured surfaces may be provided in adhesion promotion structures 152, in antennas 40A and 40B and/or on the opposing surfaces to which adhesive joints are being formed with adhesion promotion structures 152 and/or antennas 40A and 40B.

Figure 13:
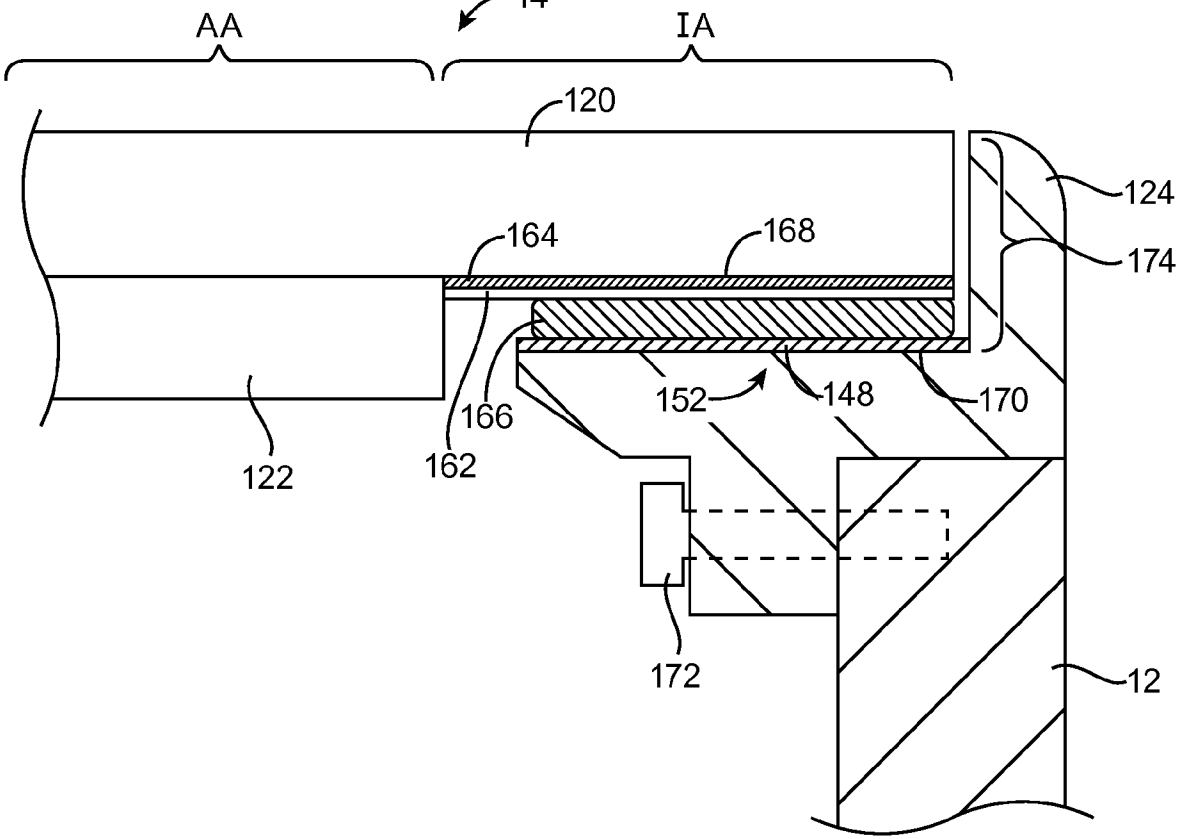
FIG. 13 is a cross-sectional side view of the plastic frame of FIG. 12 taken though an illustrative adhesion promotion structure in accordance with an embodiment.

FIG. 13 is a cross-sectional side view of adhesion promotion structure 152 of FIG. 12 in device 10 taken along line 154 of FIG. 12 and viewed in direction 156. As shown in FIG. 13, display module 122 may be mounted under active area AA of display 14. Display cover layer 120 is transparent, so that images from module 122 may pass through display cover layer 120 in active area AA.

Inner (lower) surface 168 of display cover layer 120 in inactive area IA may be coated with one or more coating layers such as layers 164 and 162. Layer 164 may be formed from one or more layers of opaque masking material such as one or more layers of black ink, one or more layers of white ink, or one or more layers of ink of other colors (e.g., opaque polymer coating layers). Layer 162 may be a clear coat of adhesion promoting material (e.g., a polymer, etc.) or other adhesion promoting layer. Fewer coating layers or more coating layers may be provided on display cover layer 120 in inactive area IA, if desired. The use of layers 164 and 162 in the example of FIG. 13 is merely illustrative. Moreover, layer 164 and/or layer 162 and/or inner surface 168 may, if desired, be textured to promote adhesion between display cover layer 120 and adhesive as described in connection with FIGS. 9 and 10.

Adhesive layer 166 may be used to form an adhesive bond (adhesive joint) that attaches display cover layer 120 to frame 124. Adhesive layer 166 may be pressure sensitive adhesive (e.g., adhesive tape), liquid adhesive, or other suitable adhesive. Frame 124 may have a ledge with a horizontal surface such as surface 170 in inactive area IA. Display cover layer 120 may have a corresponding horizontal surface such as surface 168 in inactive area IA. Adhesive 166 may be interposed between display cover layer 120 and frame 124 (e.g., between coatings 162 and 164 on display cover layer 120 and metal coating 148 on frame 124) form an adhesive bond in inactive area that attaches surface 168 to surface 170. Adhesion promotion structure 152 (i.e., non-antenna adhesion promotion structure 152) may be formed from metal coating layer 148 on surface 170 of frame 124 to enhance adhesion between frame 124 and adhesive 166. If desired, surface 170 and/or metal coating layer 148 may be textured to promote adhesion to adhesive 166 as described in connection with FIGS. 9 and 10. Other frame surfaces such as vertical surface 174 may also be coated with metal 148 and adhesive 166 to attach frame 124 and display 14 or vertical surfaces such as vertical surface 174 may be left free of metal and/or adhesive.

Figure 14:
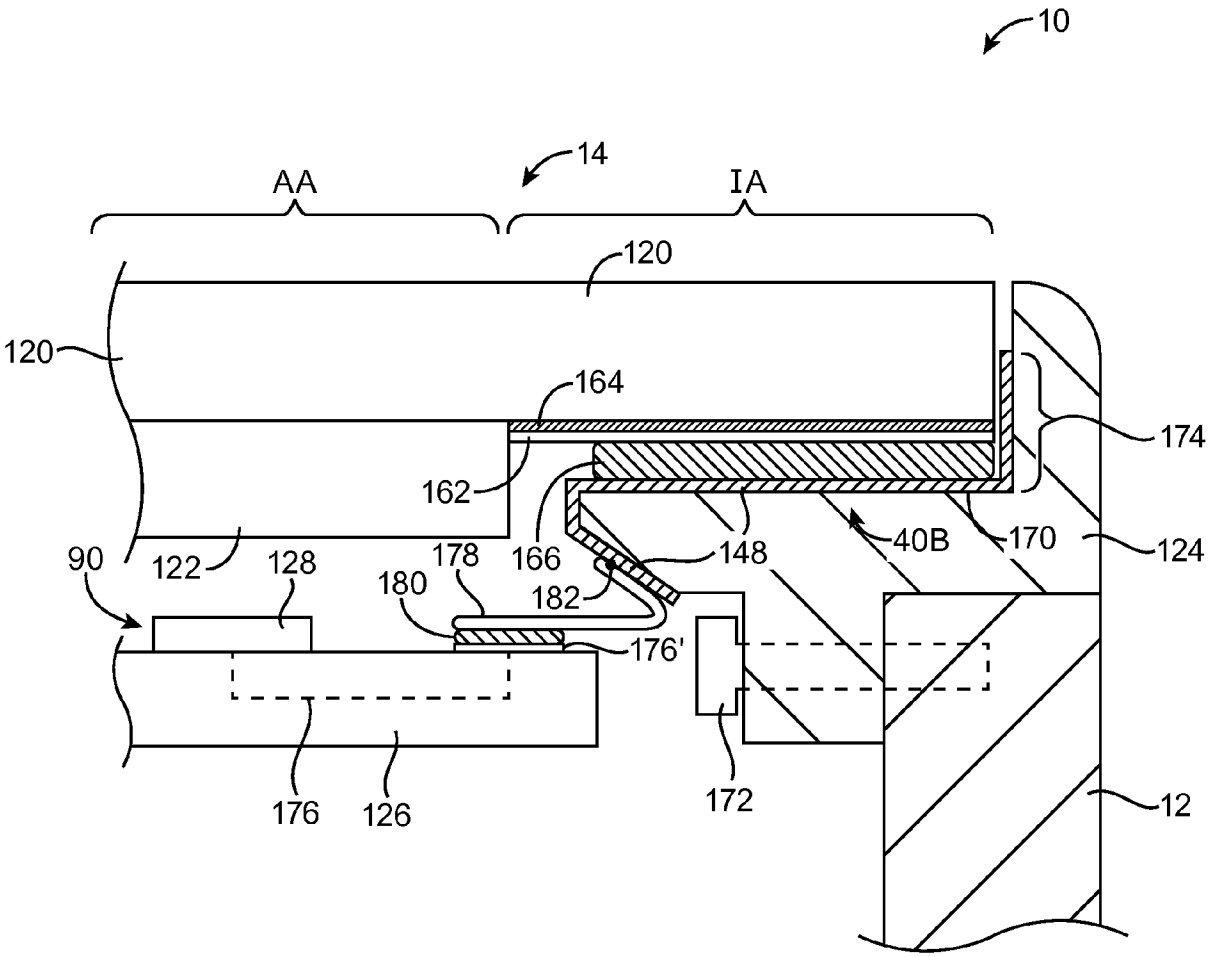
FIG. 14 is a cross-sectional side view of the plastic frame of FIG. 13 taken through an illustrative antenna structure that also serves as an adhesion promotion structure in accordance with an embodiment.

One or more fasteners such as screw 172 may be used to attach frame 124 to housing 12. In the example of FIG. 13, frame 124 has an opening to accommodate the shaft of screw 172 and housing 12 has a threaded opening that receives the shaft of screw 172. Mounting configurations for frame 124 that attach frame 124 to housing 12 without using screws may be used, if desired. The configuration of FIG. 13 is merely illustrative The portion of metal 148 that forms antenna structures on frame 124 may be coated with adhesive 166 (i.e., adhesive layer 166 may overlap antennas 40A and 40B). FIG. 14 is a cross-sectional side view of device 10 in the vicinity of antenna 40B of FIG. 12 taken along line 158 of FIG. 12 and viewed in direction 160. As shown in FIG. 14, device 10 may include radio-frequency transceiver circuitry 90. Radio-frequency transceiver circuitry 90 may be formed from one or more integrated circuits or other circuitry 128 on printed circuit 126. Signal paths within printed circuit 126 such as interconnect(s) 176 may be used in forming transmission line 92 (FIG. 6).

Antenna 40B may be formed from patterned metal layer 148 on frame 124. A conductive coupling structure such as spring 178 may be used to electrically short printed circuit board interconnects 176 to metal 148 of antenna 40B. Spring 178 may be soldered to printed circuit board contact 176' (part of interconnects 176) using solder 180 or solder may be used to attach spring 178 to metal 148. Spring 178 may contact metal 148 at contact point 182. Other coupling structures such as spring-loaded pins may also be used in coupling transmission line paths to antenna structures such as metal 148. The transmission line paths may be formed from coaxial cables, traces in a rigid printed circuit board, traces in a flexible printed circuit (e.g., a flexible printed circuit cable), etc. The configuration of FIG. 14 in which spring 178 is used to connect antenna 148 to transceiver circuitry 90 is shown as an example.

Screw 172 or other attachment mechanisms may be used to mount frame 124 to housing 12. Metal 148 may be formed on horizontal surface 170 of frame 124 and/or other portions of frame 124 such as vertical surface 174. Adhesive 166 may be applied to surface 170 (i.e., where adhesive 166 is overlapped by the portion of display cover layer 120 in inactive area IA) and/or adhesive 166 may be applied to the surface of frame 124 in region 174. Coatings such as coatings 162 and 164 may be formed on the underside of display cover layer 120 in inactive area IA of display 14, as described in connection with FIG. 13. Textures may be formed in metal 148 and frame 124, in display cover layer 120 and coatings 164 and 162, in coatings 164 and 162, or elsewhere to promote adhesion between adhesive 166 and the structures contacted by adhesive 166.

The foregoing is merely illustrative and various modifications can be made by those skilled in the art without departing from the scope and spirit of the described embodiments. The foregoing embodiments may be implemented individually or in any combination.

What is claimed is:

1. An electronic device, comprising:
a housing;
a display frame attached to the housing;
a display mounted in the display frame, wherein the display comprises display structures that display images in an active area of the display, and wherein the display frame surrounds the active area of the display; and
a patterned metal layer on the display frame that forms an antenna.

2. The electronic device defined in claim 1 wherein the display frame comprises plastic.

3. The electronic device defined in claim 2 further comprising adhesive on the patterned metal layer that attaches the display frame to the display.

4. The electronic device defined in claim 3 wherein the display comprises a display cover layer and wherein the electronic device further comprising coating layers on an inner surface of the display cover layer and wherein the adhesive is between the coating layers and the patterned metal layer.

5. The electronic device defined in claim 4 wherein the coating layers include an opaque masking layer.

6. The electronic device defined in claim 5 wherein the coating layers are textured to promote adhesion to the adhesive.

7. The electronic device defined in claim 6 wherein the patterned metal layer further comprises a portion that forms a non-antenna adhesion promotion structure.

8. The electronic device defined in claim 7 wherein the frame has edges and wherein the adhesion promotion structure comprises metal on the plastic of the frame along one of the edges, the electronic device further comprising a texture on the frame to promote adhesion to the adhesive.

9. The electronic device defined in claim 3 further comprising:
a printed circuit;
radio-frequency transceiver circuitry on the printed circuit;
an interconnect on the printed circuit that is coupled to the radio-frequency transceiver circuitry; and
a conductive coupling structure that is shorted between the interconnect and the antenna and that couples radio-frequency transceiver circuitry to the antenna.

10. The electronic device defined in claim 9 wherein the conductive coupling structure comprises a spring.

11. The electronic device defined in claim 3 wherein the display comprises a display cover layer that is coated with opaque masking material in an inactive area of the display, and wherein the opaque masking material overlaps the antenna.

12. The electronic device defined in claim 1 wherein the display frame comprises a plastic display frame and wherein the patterned metal layer comprises electroplated metal over a laser-activated area of the plastic display frame.

13. The electronic device defined in claim 12 wherein the display frame comprises a plastic display frame having first and second shots of molded plastic and wherein the patterned metal layer comprises electroplated metal over the second shot of molded plastic.

14. The electronic device defined in claim 1 further comprising a screw that attaches the display frame to the housing.

15. The electronic device defined in claim 1, wherein the display frame has the shape of a rectangular ring with a rectangular opening that receives the display structures of the display.

16. An electronic device, comprising:

a housing;

a display frame attached to the housing;

a display having display structures that display images in an active area of the display and having a display cover layer that overlaps an inactive area of the display, wherein the display frame has the shape of a rectangular ring with a rectangular opening that receives the display structures of the display;

adhesive in the inactive area that attaches the display cover layer to the display frame; and an antenna formed from a metal layer on a portion of the display frame.

17. The electronic device defined in claim 16 wherein the display frame comprises a plastic display frame having a surface and wherein the metal layer is a patterned metal coating on the surface under at least some of the adhesive.

18. An electronic device comprising:

a metal housing with a sidewall;

a display in the metal housing, wherein the display comprises display structures that display images in an active area of the display and a display cover layer that overlaps an inactive area of the display;

a plastic structure, wherein the plastic structure has a surface that is adjacent to the display cover layer;

an antenna formed from a patterned metal layer on the surface of the plastic structure such that the antenna is adjacent to the display cover layer;

a fastener, wherein the plastic structure has an opening that receives the fastener, and wherein the fastener extends through the opening in the plastic structure to screw into the sidewall of the metal housing and attach the plastic structure to the sidewall;

a printed circuit board; and a coupling structure that electrically connects the patterned metal layer to the printed circuit board.

19. The electronic device defined in claim 18, wherein the coupling structure is soldered to the printed circuit board.

20. The electronic device defined in claim 19, wherein the display cover layer is coated with opaque masking material in the inactive area of the display, and wherein the opaque masking material overlaps the antenna.

* * * * *